United States Patent [19]

Strong

[11] 4,321,807

[45] Mar. 30, 1982

[54] DRAW MECHANISM FOR STRAIGHT BAR KNITTING MACHINES

[75] Inventor: Barry C. Strong, Syston, England

[73] Assignee: William Cotton Limited, England

[21] Appl. No.: 239,132

[22] Filed: Feb. 27, 1981

Related U.S. Application Data

[63] Continuation of Ser. No. 107,255, Dec. 26, 1979, abandoned.

[30] Foreign Application Priority Data

Dec. 29, 1978 [GB] United Kingdom ..... 50244/78

[51] Int. Cl.[3] ..... D04B 15/52

[52] U.S. Cl. ..... 66/126 R

[58] Field of Search ..... 66/126 R, 130, 125, 66/127, 128

[56] References Cited

U.S. PATENT DOCUMENTS

| | | | |
|---|---|---|---|
| 2,580,603 | 1/1952 | Saunders | 66/126 R |
| 3,657,906 | 4/1972 | Swanwick | 66/126 R |

FOREIGN PATENT DOCUMENTS

| | | | |
|---|---|---|---|
| 1060542 | 9/1953 | Fed. Rep. of Germany | 66/126 R |
| 2004573 | 11/1969 | France | 66/126 R |

*Primary Examiner*—Ronald Feldbaum

*Attorney, Agent, or Firm*—Robert E. Burns; Emmanuel J. Lobato; Bruce L. Adams

[57] ABSTRACT

A draw mechanism for a straight bar knitting machine has a positively driven slurcock and a positively driven yarn carrier (i.e. not using a friction box) and drive means for reciprocating the yarn carrier on a guide means for the yarn carrier. Resilient means are provided interposed between the drive means and the carrier which urge the carrier to a normal position. In this way the carrier can be stopped in a predetermined position while the resilient means are stressed as the drive means overruns to some extent.

8 Claims, 23 Drawing Figures

138
134
142
132
132a
148
145

130
140
172
10
188
218
180
170
175
14
158
154
158
174
176
212
162
146
204
164
160
230
514
232
234
10
516
233

DRAW MECHANISM FOR STRAIGHT BAR KNITTING MACHINES

This is a continuation of application Ser. No. 107,255, filed Dec. 26, 1979 now abandoned.

DESCRIPTION

Field of Invention

The invention relates to draw mechanisms for straight bar knitting machines, to machines incorporating such draw mechanisms and more particularly to high speed straight bar knitting machines or such machines possessing few knitting sections.

Background of the Invention

The draw mechanisms for straight bar knitting machines having many knitting sections generally comprise:

a. a cam rotating at half the speed of a main cam shaft of the machine for bringing about a reciprocating motion of a rocking lever;

b. a coupling box fast on a slur bar and connected to the rocking lever to reciprocate a series of slurcocks on a common slur bar, one slurcock being provided for each section behind the corresponding knitting head and a friction box rod connected to the coupling box;

c. a friction box on the rod to participate in its movement to the extent permitted by stops, the box sliding over the rod when it comes up against a stop before the end of the rod movement; and d. a plurality of slidable carrier rods which can be coupled through dogs selectively to the friction box and yarn carrier on the rods to lay in the yarn between sinkers and needles of the knitting machine during a draw motion.

The basic lay-out of this mechanism has not varied much, although details of friction boxes, stops etc. have been refined to permit high operating speeds and automatic carrier selection. In multi-section machines the yarn may pass between carrier rails. In order to permit the friction box to couple to the rods and reciprocate without interfering with the yarn supply, the friction box is generally accommodated in a special section of the straight bar knitting machine devoid of a knitting head.

The Wildmar British Patent Specification 411, 539 describes a single section straight bar knitting machine with a modified draw mechanism to enable draw and knitting components to be accommodated in a single section. Steel bands pass along the front of the knitting head where they lay in yarn to the rear in an endless path. The bands are spaced at the rear and the draw mechanism is accommodated to the rear of the knitting head to act on the spaced apart portions of the bands. The draw mechanism still follows the basic lay-out previously discussed:

a. a lever operated by a cam rotates a cylinder with helical grooves. The cam and lever rotate the cylinder clockwise and anticlockwise alternately;

b. a coupling device is reciprocated to and fro and reciprocates one slurcock;

c. a band connected to the coupling device to reciprocate a driver block with pawls for picking up dogs, which driver block is equivalent to the friction box; and d. the carrier bands for laying in the yarn. Stops engage the individual carrier bands whilst the drive block continues to reciprocate fully.

These known draw mechanisms cannot be used at high speeds as "carrier bounce" occurs, the friction being insufficient to stop the friction box from recoiling on impact with the stop. The draw mechanisms are also complex, require considerable space and the number of moving components is high giving rise to considerable inertia and wear. Steel bands break as a result of the strains involved in their use, whereas carrier rods require considerable free space at each end of the machine to permit reciprocation.

BRIEF DESCRIPTION OF INVENTION

The invention utilises a positive drive for both the slurcock and the yarn carrier so as to remove the need for a friction box altogether. The positive drive arrangement may be adapted to maintain the usual carrier lead. This may be done by a differential drive mechanism which superimposes a subsidiary motion on a main traversing motion so as to obtain the required difference in the slurcock and yarn carrier motion when required.

The yarn carrier arrangements may also be used with other positive drive including constant draw width mechanisms where the invention provides the advantage of simplicity and anti-rebound characteristics including draw mechanisms permitting some variation in draw width including separate but synchronised variable draw mechanisms for the carriers.

The positive drive arrangement can be arranged to cooperate with stops for locating yarn carriers using resilient means without surprisingly influencing the lead of the carrier during a traverse. By using a resilient connection between a drive for the yarn carrier and the yarn carrier, the yarn carrier can be pressed against a stop resiliently so avoiding bounce and whilst providing positive drive. The resilient connection also permits so-called carrier widening whereby the carrier is shifted outwards during a knit cycle to increase the number of needles around which yarn will be kinked during a subsequent draw cycle. The stop is moved outward for widening and the yarn carrier travels along with the stop under the pressure exerted by the resilient means. No latches are necessary for pulling the carrier along with the stop during widening or for preventing rebound. Latches may be used when the carriers are parked in an inactive condition.

The invention is particularly suitable for compact straight bar knitting machine constructions. Belts can be used to drive the yarn carriers. The belts can be driven by pulleys on the side of the knitting head. No friction box arrangement needs to be accommodated.

In an embodiment for a multi-section straight bar knitting machine, the yarn carrier may be slidably mounted on a carrier rail which is itself reciprocable by a positive drive (no belt being used) and resilient means are interposed between abutments on the carrier rails and the yarn carrier. One yarn carrier, resilient means and set of abutments may be provided per carrier rail per section. The resultant yarn carrier control is simple, light and cheap.

Advantageously for single section machines and for high speed operation, belts are used and the yarn carrier is slidably mounted on a guide rod which is itself fixed and the yarn carrier is reciprocated in tension in each direction of traverse by a belt which may be arranged as described previously. The belt may carry a drive block slidable on the guide rod and the resilient devices may be compression springs around the guide rod between the yarn carrier and the drive block. Re-bound can be substantially avoided and the movable mass is small.

Using this arrangement the guide and thickness can be reduced whilst maintaining stiffness by tensioning the rods. The invention permits a variable draw mechanism to drive the yarn carrier positively whilst maintaining a high accuracy for positioning the yarn carrier at the end of a draw.

The arrangement can give highly accurate carrier positioning at high speeds without appreciable bounce as the resilient motion urges the carrier against the stop and reduces re-bound. At the same time the accuracy of the positive drive arrangement is less critical and does not appreciably affect carrier positioning inspite of the fact that the carrier is positively driven in the course of a traverse. Finally the arrangement permits the drive motions to be made gradual and to avoid sudden accelerations or decelerations of carriers which might lead to excessive wear or breakdowns.

The means for guiding the carriers can be designed surprisingly compactly and provided with considerable stiffness to provide a straight bar knitting machine which is quite compact overall. Suitably a plurality of carriers are provided mounted on a mounting comprising a plurality of carrier guide rods, a spacer rod and a tensioning rod on the other of the spacer rods from the guide rods so that the guide rods can be stiffened by tension. By using tensioning a high stiffness permitting high speed traverses can be obtained without excessive bulk of the carrier mounting. Conveniently the carriers have a yoke mounted on the respective guide rod and the second differential output has a block slidable on the respective guide rods and spaced to either side by compression springs from the carrier yoke and the stops have resilient bushes for abutting with the carrier whilst a plurality of wires guide the yarn laying ends depending below the yokes.

Whilst the differential drive and the yarn carrier drive are used in combination in the following detailed description to provide compactness, high speed and simplicity in combination, in fact some of the above objectives may be realised using the differential drive or the yarn carrier drive alone in combination with mechanisms differing from those shown in the detailed description.

In the different Figures only those parts illustrated by the Figure concerned are shown for clarity.

DETAILED DESCRIPTION OF A BACK TO BACK MACHINE CARCAS

Figure 1:
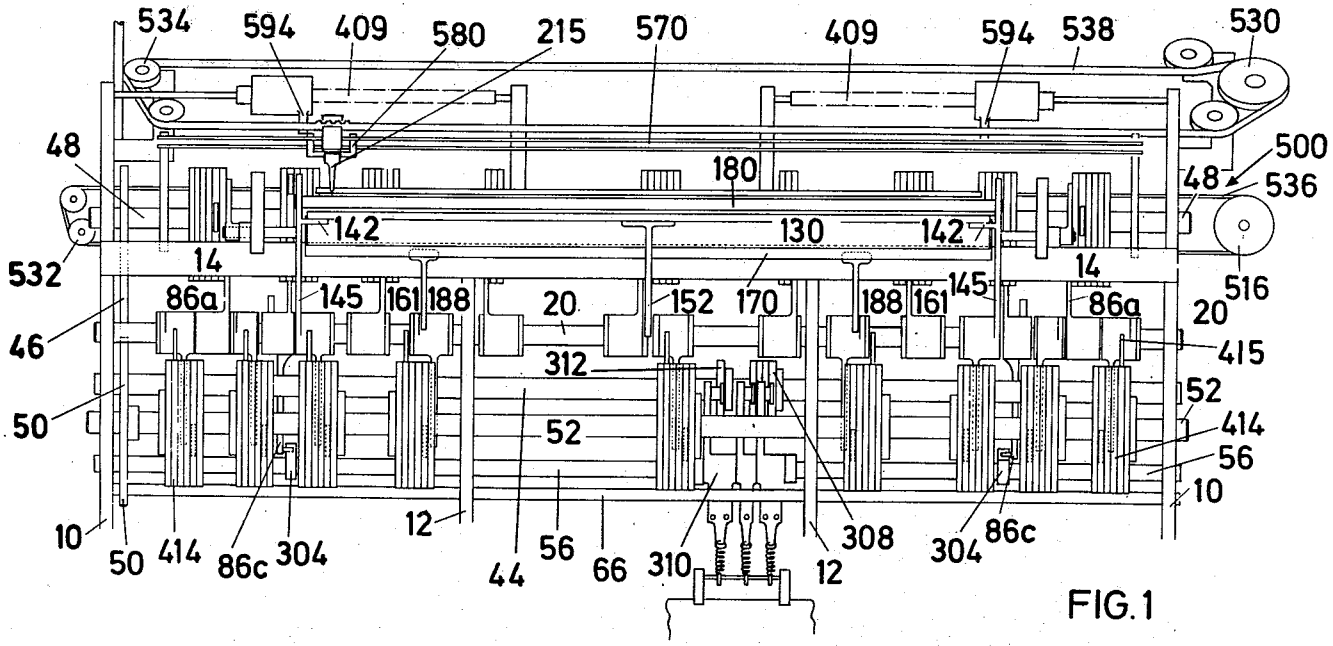
FIG. 1 is a front view (the rear view is the same) showing schematically the parts of a straight bar knitting machine of the invention, having a single yarn carrier, between end standards thereof.
Figure 2:
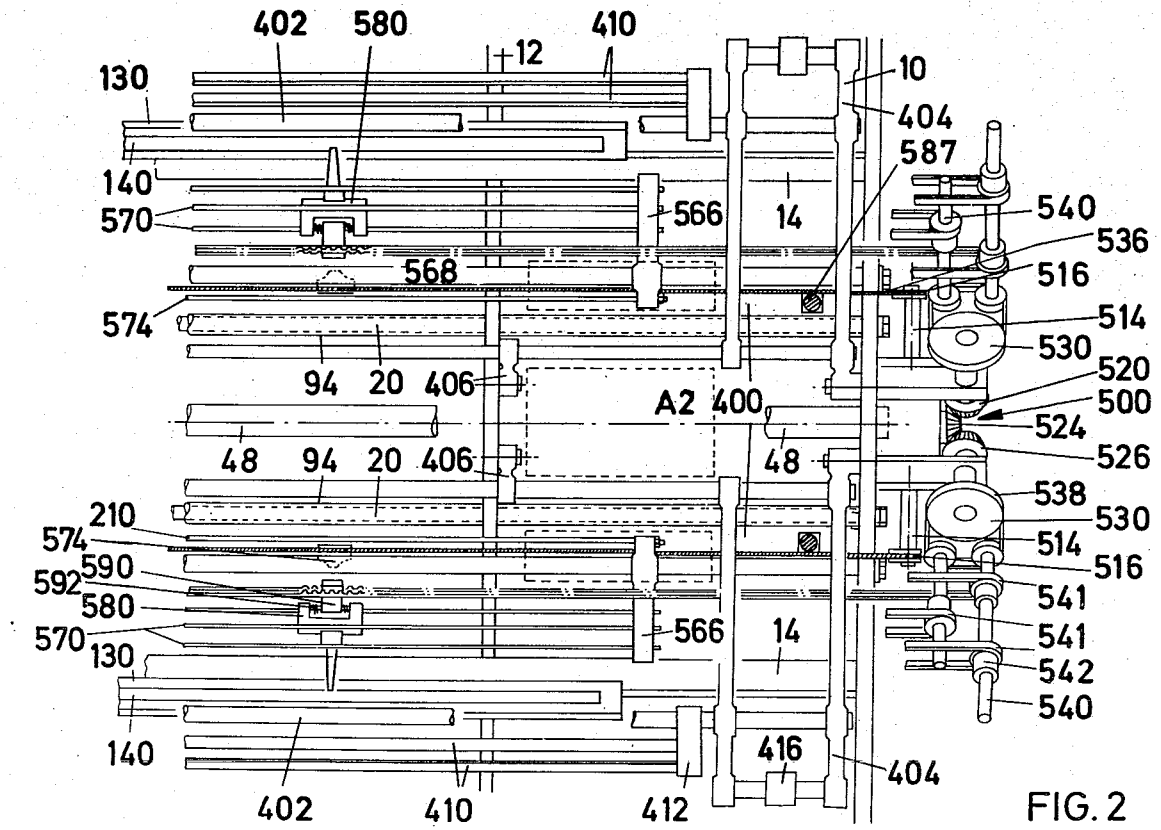
FIG. 2 is a schematic view from above of part of the machine of FIG. 1 but having three selectively operable yarn carriers and showing main mounting components.
Figure 4:
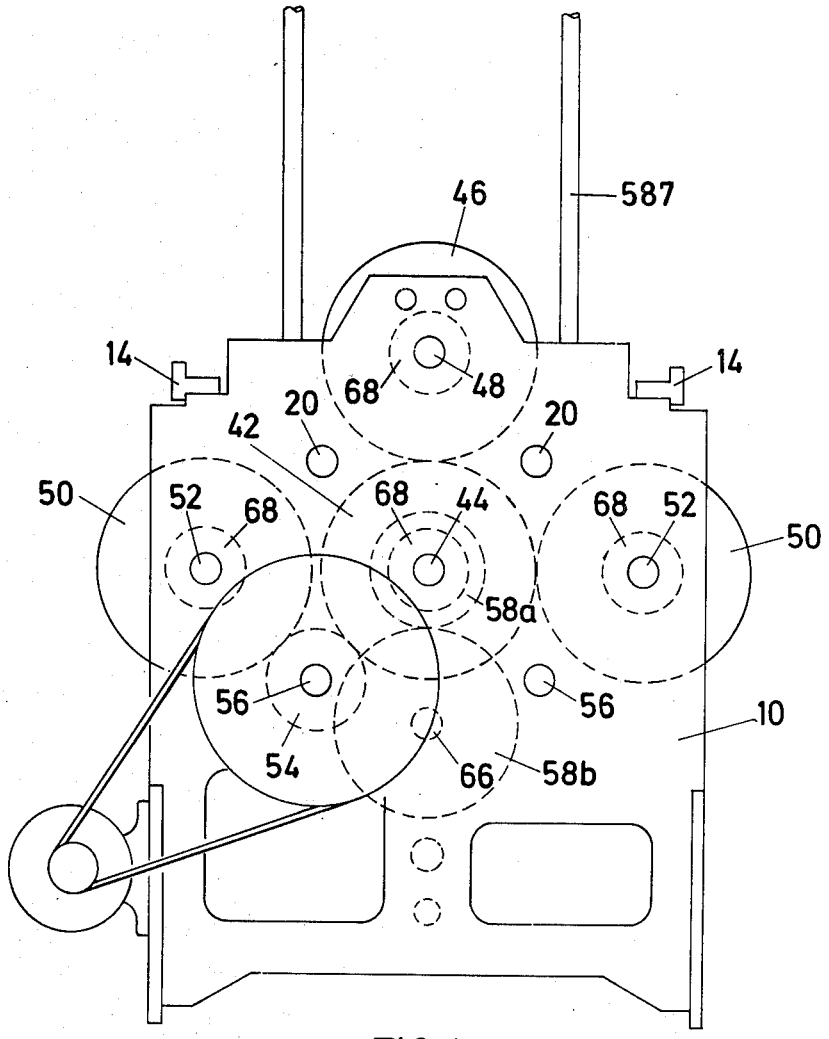
FIG. 4 is an end view from the left in FIG. 1 of the carcass of the machine of FIG. 1 and FIG. 2.

The only significant difference between the machines in FIG. 1 and FIG. 2 lies in the number of yarn carriers and are identical otherwise. With reference particularly to FIG. 1, FIG. 2 and FIG. 4, a carcass or frame of a straight bar knitting machine according to the invention has transverse end standards 10 and intermediate standards 12 which standards are all interconnected by a pair of longitudinally extending head rails 14 and a pair of lower rails 16. A middle rail may be added between the lower rails 16. Rods 20 (FIG. 2) extend between the end standards 10 to which they are secured by nuts. Sleeves 94 are mounted on the rods between the standards and levers 86 are freely pivotable between pairs of collars secured to the sleeves 94. The pair of head rails each support a knitting head. The components of the different knitting heads are the same and they perform the same operation at the same time.

DRIVE

Figure 9:
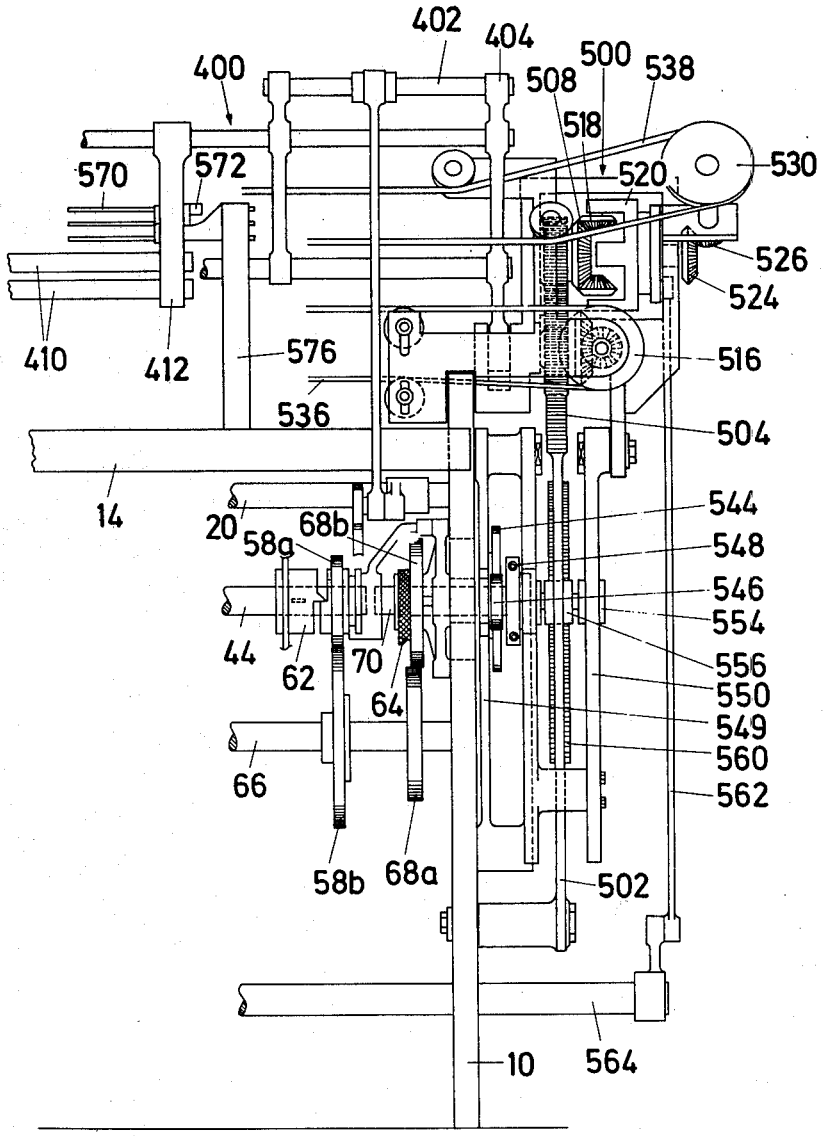
FIG. 9 is a detailed front view, partly broken away, of the portion of FIG. 1 at the right hand end adjacent the portion shown in FIG. 8.

With reference particularly to FIGS. 4 and 9, a motor is secured to one end-standard 10 to the left hand side in FIG. 1 and drives an input gear 54. A sun gear 42, mounted on a full speed shaft 44 received in bearings 68 in the standards 10 and 12 (shown slightly below its proper position in FIG. 1 for illustrative purposes) meshes with the input gear 54. The sun gear 42 in turn meshes with:

a. a top planet gear 46 and a top cam shaft 48 received in bearings 68 in the standards 10 and 12; and b. one bottom planet gear 50 on a bottom cam shaft 52 received in bearings 68 in the standards.

The gear 54 is rotatable on an axis 56 on a stubshaft and meshes with another bottom planet gear 50. This other planet gear is similarly mounted as the former planet gear 50 but rotates in the opposite direction.

The cam shafts 48 and 52 can be shifted longitudinally at the same time by cam shaft shogging mechanisms located inside cover on the left hand side of the machine as seen in FIG. 1 to transfer control of the different knitting motions from one set of cams to another set of cams.

The shogging mechanism operates analogously to known shogging devices using selecting props for projecting plungers into face cams in cam shafts except that in this case each shaft has a face cam and three plungers are provided for being projected simultaneously to shog the cam shafts axially.

The full speed shaft 44 is drivingly connected (FIG. 9) through a clutch 62 and reduction gears 58*a* and 58*b* to a half speed shaft 66 (See FIG. 9). A gear 68*a*, driven from the shaft 66, meshes with a gear 68*b* on the draw cam shaft 70 which shaft is mounted on the same centre line as shaft 44, thus providing a half speed to the draw cam 544. A leather belt 64 is brought into contact with a boss on gear 68*b* by means of mechanism (not shown) to act as a brake on the draw cam, prior to disengagement of the clutch. The half speed shaft 66 serves to operate the draw mechanism.

The drive described so far serves to operate the knitting and draw mechanism for the knitting heads on each of the head rails 14. The full speed shaft 44 serves to rotate the cam shafts 48 and 52 at the same speed as the shaft 44. The cams on these shafts 48 and 52 are generally used to operate levers for controlling different transversely movable bars of the knitting heads. The shaft 44 also serves to rotate a further cam by way of the half speed shaft 66 which operates the draw mechanism described subsequently.

CAMS AND LEVERS

Figure 17:
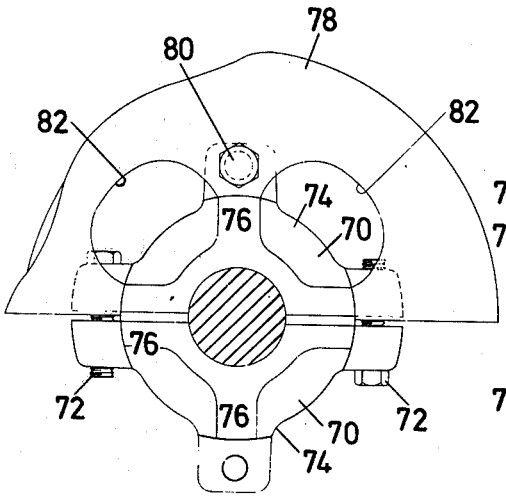
FIG. 17 is a side view of a partially assembled cam pack of the machine of FIGS. 1 and 2 and FIG. 18 a front view.
Figure 18:
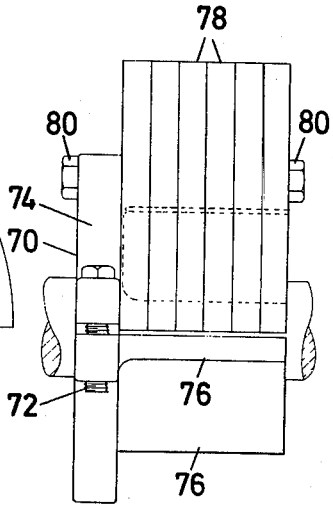

Cams for operating the different transversely movable bars are arranged in packs on the cam shafts 48 and 52. The cam shaft 48 supports two sets of packs, one for each of the knitting heads. Each pack is located on a hub comprising (see FIG. 17 and FIG. 18) two hub halves 70 secured together at one end by bolts 72 passed through projections at a locating rim 74. Each hub half 70 has three radially projecting ridges 76 for supporting cam halves 78 fastened together in a pack and secured by bolts 80 to a further projection from the locating rim 74. The cam halves 78 have cut-away central portions 82 to reduce their mass. The cam halves 78 are thus closely adjacent. The cam pack assembly can be easily dismantled without disturbing any adjacent cam packs.

Figure 15:
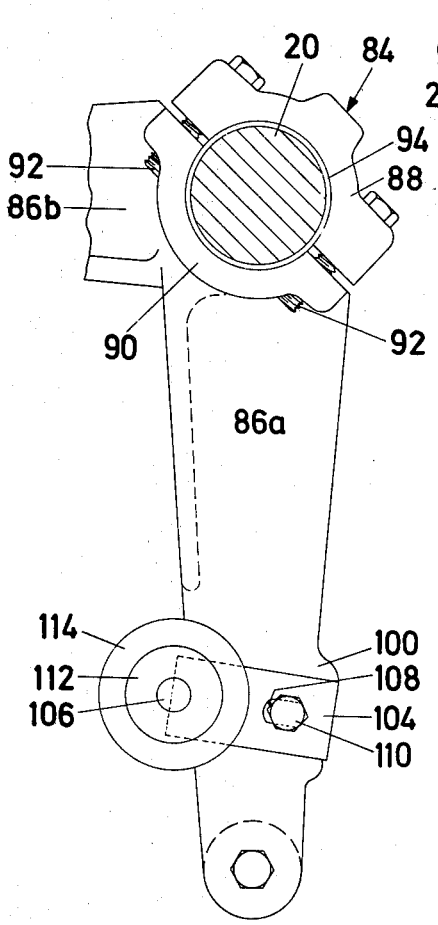
FIG. 15 is a side view of a lever of the machine of FIGS. 1 and 2 and FIG. 16 a front view showing adjacent parts.
Figure 16:
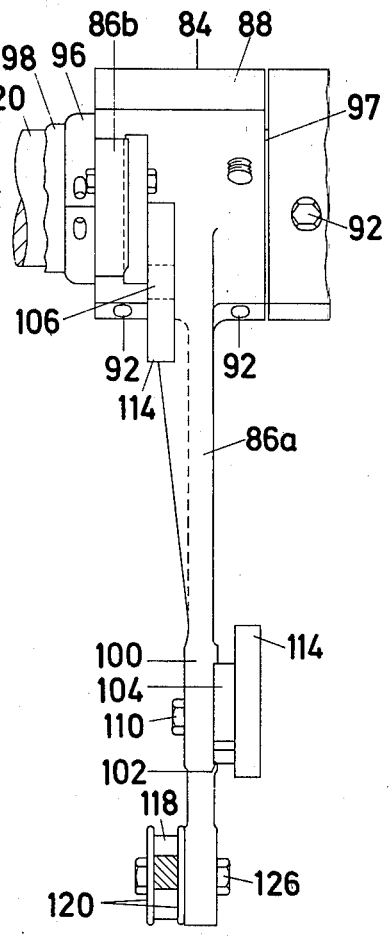

Each cam pack is associated with a particular lever. The levers operated by the cam packs on the shafts 48 and 52 are arranged in rows on the lever shafts 20. Each lever (See FIG. 15 and FIG. 16) has a hub 84 and a pair of lever arms 86*a* and 86*b*. The hub 84 is constituted by a fastening half section 88, and a lever arm carrying half section 90. Bolts 92 hold the sections 88 and 90 together. The hub 84 is mounted on a bearing sleeve 94 surrounding the shaft 20 and is held against lengthwise movement by locating rings 96 and spacing sleeves 98. The hub 84 may bear against a shim 97 spacing two adjacent levers. Both arms 86*a* and 86*b* have a thickened arm portion 100 with an aperture (not shown).

The cam followers can be made to follow the cam contour accurately by adjusting the position of the mounting plates 104 with respect to the arms 86 using the bolts 110.

For standardisation purposes levers may be produced in right or left hand versions which are dimensionally the same. Portions 102 may be milled on the left or right hand side of the arms 86*a* and 86*b* and fitted with mounting plates 104 with a spigot 106 carrying cam followers as appropriate, giving a total of four different lever configurations.

The spigot 106 is cutaway under the plate 104 to provide a straight lower edge for the plate 104.

The cam followers, which may include balls in a ball race, has a thin cross section and can follow a cam surface even though cam surfaces on either side thereof are raised.

Links or connecting arms may be pivotably secured to the end of the arms 86*a* by means of pivotal connections with bearings.

It is a significant feature of the invention that such standardised cam pack, lever, connecting arm and link arrangements be used for most motions of the transversely movable bars of the knitting head and possibly also for other cam controlled operations such as fashioning and lead screw racking. In the following, the individual bars will be described with only brief references to the lever cam and link arrangement which is generally as that described here. However where appropriate a single lever arm may be used for certain levers with spring return where this can be done without causing jumping of follower off cams. Also instead of the half section 88 another section can be used having a single lever arm in the case of the levers for the needle bar in-out motion (see FIG. 7).

KNITTING HEAD

With reference particularly to FIGS. 7 to 12 each knitting head includes a needle bar 130 comprising a needle bed 132 which cooperates with clamps 132*a* at its front to fix sets of bearded needles. A flange 134 is formed integrally with the bed 132 from aluminum at the rear of the bed 132 and at the level of the clamped needle portions. Carbon fibre reinforcement strips 140 are bonded to the aluminium in shallow grooves formed in the flange 134.

The bar is secured at each end to mounting brackets 142 located under the flange 134 by means of bolts 138. The brackets 142 are welded at an intermediate position to rigid up-down connecting arms 145. Guide plates 148 fastened to the rear rail 14 prevent sideways movement of the needle bar connecting arms 145 allowing only in-out and up-down movement.

The up-down connection arms 145 are pivotably connected at the top to in-out links 146 at a position above the needle bar 130 and in line with the row formed by the needle beards. The links 146 pass over the top of head rail 14 and are each operated simultaneously by upright lever arm 86*a* behind the knitting head of similar lever to pull the needle bar 130 into press moving it towards the head rail 14 under the influence of cam pack arrangements at each end of the needle bar 130. The up-down arms 145 are pivotably connected at the bottom to up-down lever arms 86*a* (FIG. 10) which are at a level below the knitting head and pass under the head rail 14 substantially parallel to the links 146. The needle bar 130 is supported between its ends by an intermediate arm 152 (FIG. 1). The different lever arms are all mounted on the lever shaft 20.

Figure 7:
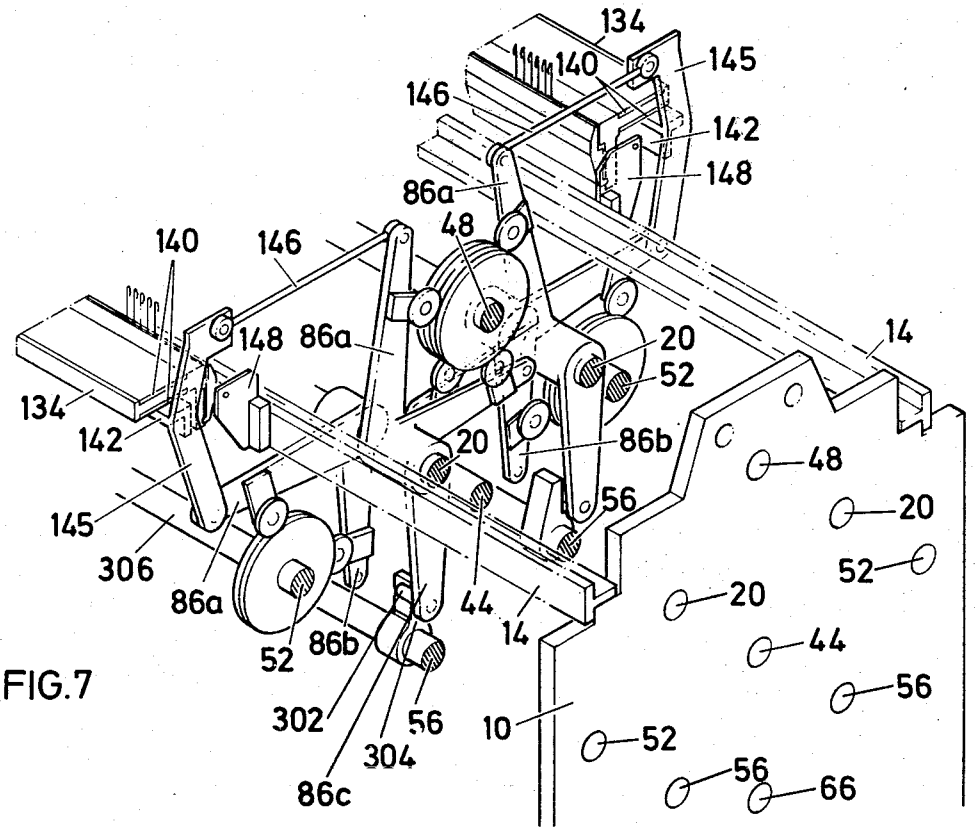
FIG. 7 is a perspective view, partly broken away, of parts of the knitting machine of FIGS. 1 and 2 for actuating needle bars.
Figure 11:
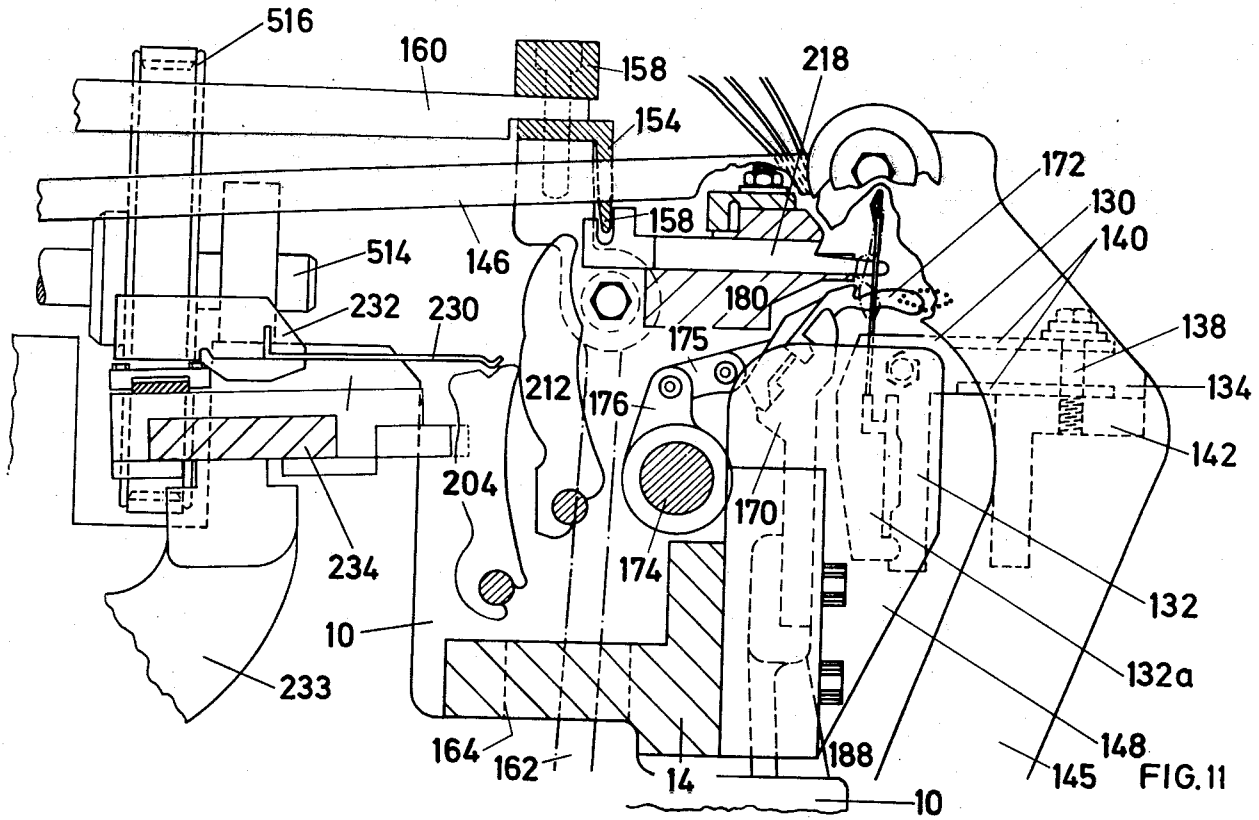
FIG. 11 shows part of FIG. 10 which is blank suitably enlarged in a partly cut away section.

With reference particularly to FIGS. 7 and 11, it can be seen how the overall effect is that each end of each needle bar is mounted by a rectangular lever, connecting arm and link arrangement with the rows of needle beards adjacent an outer and upper corner and with the lever shafts 20 at the inner and lower corner. Both the rows of needle beards and the head rails 14 and associated sinker bars are on a diagonal line between these aforementioned corners. The overall rectangular lever link arrangement and the needle bar and knitting head which occupy part of the cross-sectional area within the lever-link arrangement, is very compact and the top cam shaft 48 can be accommodated between two symmetrically arranged lever-link arrangements for direct transmission of cam follower movement to the needle bar. The front and rear needle bars 130 are longitudinally off-set so that each are operated directly by cam packs arranged side by side on the top cam shaft 48. Space remains below each of the knitting heads for the further bottom cam shafts 52 and cam packs and any other mechanisms. The needle bar is thus operated to cause the tip of the needles to follow the path shown chain dotted in FIG. 11.

The needle bar 130 is controlled by a quality control mechanism during the draw cycle when the bar 130 is stationary whilst the new yarn is being laid in by the carrier and sinkers. The draw position can be varied by the quality control mechanism as follows.

The needle bar in-out levers have each a third lever arm 86C (FIG. 7) which carries a pin 302 for engaging a quality lever 304 on a quality shaft 306 on the axis 56, one shaft being provided for each knitting head. Linkages connect the quality shafts 306 to ensure their simultaneous movement. The cams on the shaft 48 for controlling the needle bar in-out motion during a knit cycle are cut away at the sector passing the cam followers during the draw cycle so as to give the levers freedom of motion and enable the needle bar to be set closer or further away from the head rail 14 to give the quality required. The quality shafts 306 are oscillated in synchronism with the rotation of the cam shaft 48 to give the desired quality or stitch length.

The movement of the quality control shafts 306 can be timed in the usual way by alternative cams 308 (FIG. 1) on the main drive shaft 44 which is not shogged to suit fashioning and normal knitting and the extent of the movement transmitted to both shafts 306 to suit fashioning and normal knitting can be set by alternative props (not shown) for the levers 310 engaging the cams. A cam 312 is provided to enable the appropriate props to be reselected. Once a prop is selected for a particular lever, that lever will impart a motion to the quality shaft of predetermined timing and extent.

Figure 8:
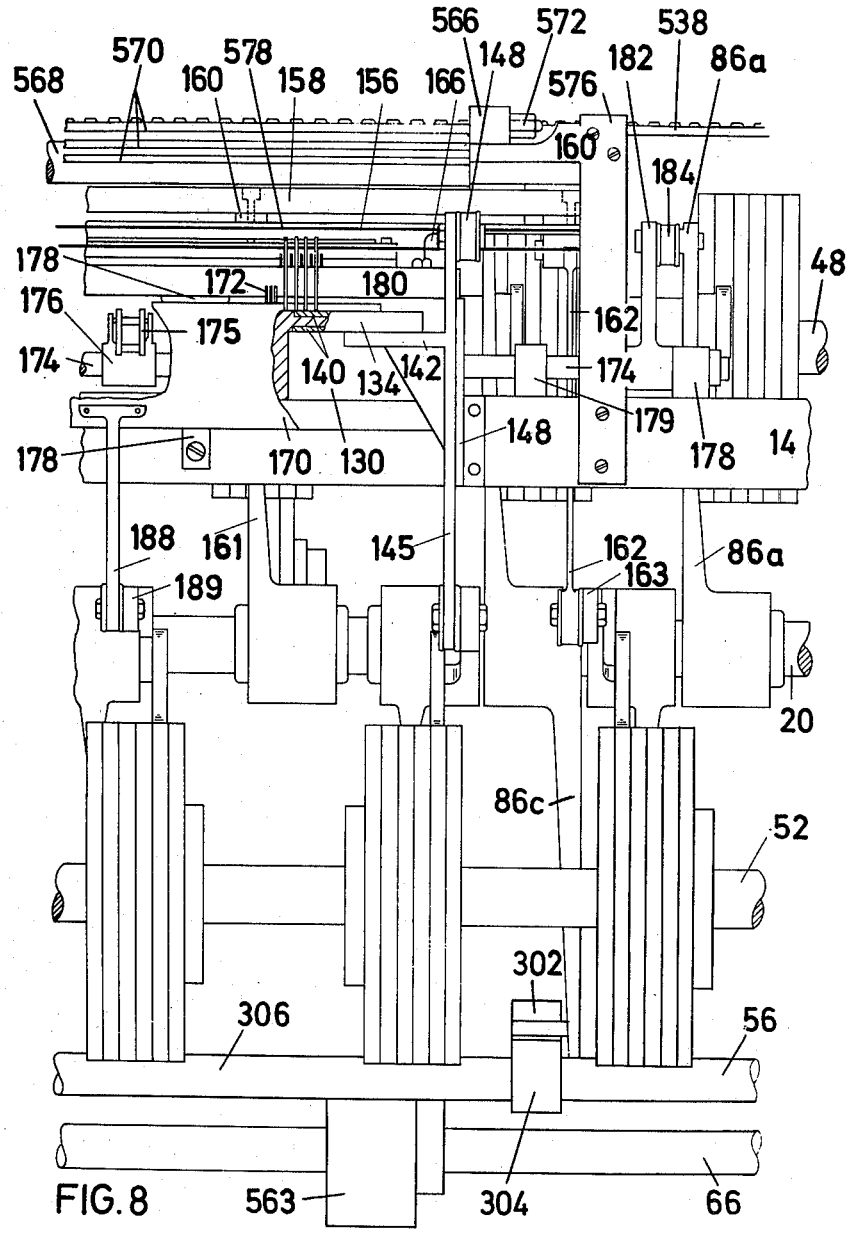
FIG. 8 is a detailed front view of the portion of FIG. 1 containing one end of a needle bar, the other end being symetrically arranged but otherwise the same.

With reference to FIGS. 8 and 11 each knitting head includes a catch bar 154 having a sinker butt engaging member 156 and a carbon fibre reinforcement strip 158. The catch bar 154 is supported by in-out connecting arms 160 at its ends and at intermediate positions. The arms 160 are not pivotable with respect to the catch bar 154. The catch bar 154 is further supported at its ends only by up-down connecting arms 162 passing through slots 164 in the head rail 14 arranged to the outside of the needle bar up-down arms 145. The sinker butt engaging member 156 is cut away at 166 to enable the catch bar 154 to fit closely over the needle bar in-out arms 146. The various connecting arms are secured to the ends of the lever arms as described previously. In FIG. 8, the in-out arm 160 is secured to an in-out lever arm 161 and the up-down connecting arm is secured to an up-down lever arm 163. The catch bar operates in the usual way for an all sinker machine.

With reference to FIGS. 8, 10, 11 and 12, each knitting head has a knockover bar assembly comprising a knockover bar 170 mounting knockover bits 172 and a torque shaft 174 extending alongside the rear of the knockover bar and connected thereto at a plurality of spaced positions by short links 175. The links 175 are of the kind used for chains and are pivoted on brackets on the bar 170 and brackets 176 on the shaft 174. The knockover bar 170 is supported from below between its ends by up-down connecting arms 188 pivoted on up-down lever arms 189 under the knitting head and attached directly to knockover bar 170.

The shaft 174 passes through bearings formed in nogs 178. The nogs 178 are bolted to the head rail 14 at their lower end and to a sinker bottom bar 180 at their upper end at intermediate positions and through bearing blocks 179 at the sides of the knitting head. The shaft 174 is thus located above the head rail 14 and the bearings restrain deformation of the shaft 174. At both ends, the shaft 174 carries levers 182 (FIG. 8) pivotably connected at their top to in-out links 184 operated by upright in-out lever arms **86*a*. The levers 182, links 184 and lever arms 86*a*** are located outside the control levers and links for the needle and catch bars.

The knockover bar 170 is flat and not likely to deform as a result of up-down motion. The short links 175, which are held against longitudinal movement with respect to the knockover bar in their brackets 176 firmly join the shaft 174 to the knockover bar 170. As the torque shaft 174 is held in bearings in the nogs 178, it thus holds the knockover bar against deformation resulting from in-out motion. The knockover bar assembly also permits the in-out motion to be created using the standardized cam packs, levers and links described. The resultant motion is illustrated by the dotted line in FIG. 11.

The machine illustrated in the Figures is a machine having progressively advanced jack operated sinkers only and no simultaneously advanced dividing sinkers. Thus a set of elements including a sinker, jacks, jack springs is aligned with each knockover bit 172 to advance the associated sinker between adjacent pair of needles in the needle bar 130.

Figures 12, 13:
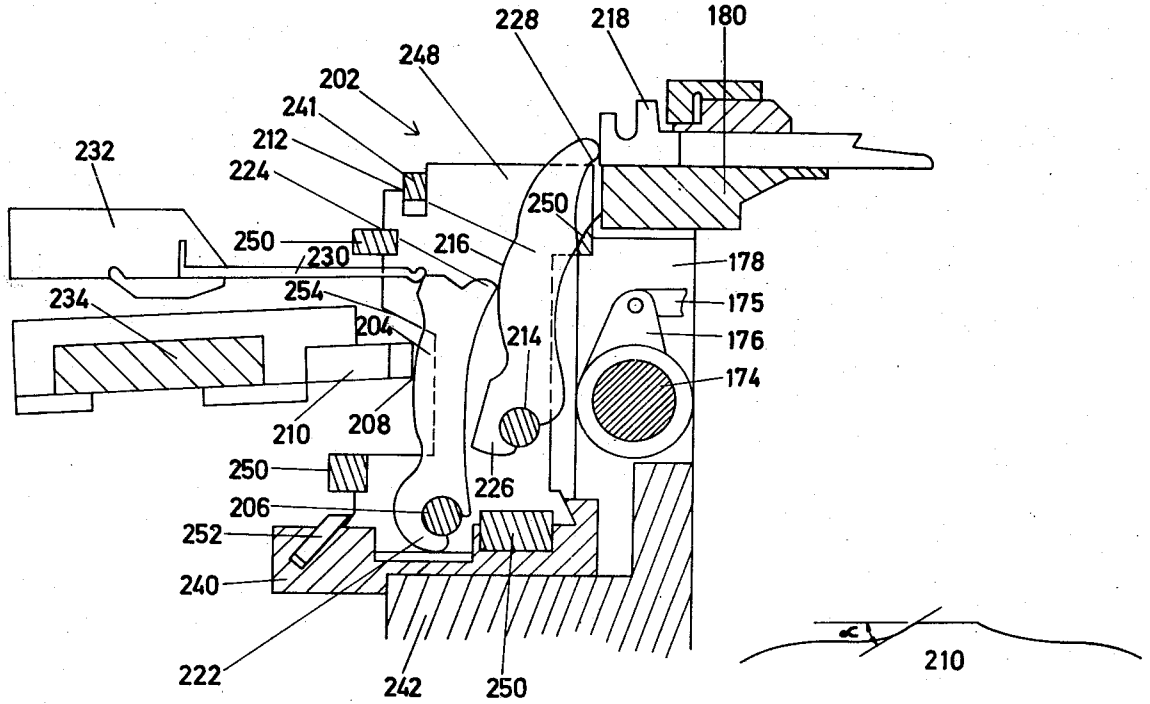
FIG. 12 shows part of FIG. 11 but in a different stage of sinkeroperation.
FIG. 13 shows a slurcock profile for advancing jacks shown in FIG. 11 and FIG. 12.

With reference to FIG. 12 a jack bar assembly, generally indicated at 202, has primary jacks 204 mounted on a longitudinally extending pivot wire 206. The jacks 204 have a rear edge forming a bulge at 208 engaged by a slurcock 210 on a slur bar 234 (see also FIG. 3). The assembly 202 further has secondary jacks 212 mounted on another longitudinally extending pivot wire 214. The jacks 212 have a rear edge with a curved part at 216. Each pair of associated primary and second jacks 204 and 212 cooperate to actuate a sinker 213 slidably mounted in the sinker bar 180.

The primary jacks 204 have pivot portions 222 with a central aperture for holding the pivot wire 206 at one end and noses 224 at the other end which bear against the curved parts 216 of the rear edges of the jacks 212 at the other end. The secondary jacks 212 have pivot portions 226 at one end and noses 228 for engaging the sinkers 218 at the other end. The noses 224 engage the curved parts 216 halfway between the ends of the jacks 212.

In this case a leverage of 3 is obtained that is the lift provided by the slurcock 210 is one third of the advance of the sinkers 218. The leverage may be varied if required by raising or lowering the slur bar 234 with respect to the primary jacks 204. FIG. 12 shows the sinkers in their advanced position. The slur bar 234 is mounted on levers by mountings 233. The levers for the front and rear knitting heads $H_1$ and $H_2$ (see FIG. 19) are actuated simultaneously and the slurbar movement at the front and rear head may be controlled through common cams on the shaft 48. The high leverage can be obtained with a jackassembly of dimensions similar to conventional ones which use only one jack to actuate each sinker and have a leverage of about 2. The vertical spacing of the pivot wire 206 and 214, is only small as is the horizontal spacing between the pivot wire 206 and 214.

The primary jacks 204 have bevelled edges at angularly spaced positions along the top edges for engaging jack springs 230 in the forward position (see FIG. 12) or in the retracted position (See FIG. 11). No shifting of the jack springs 230 in a horizontal sense is required. The jack springs are moved up and down at both front and rear knitting heads ($H_1mH_2$ (See FIG. 19) simultaneously and may be operated at front and rear head by means of common cams on the shaft 48 to raise and lower the jack springs 230 when required.

The jack bar assembly 202 can be compactly accommodated to the rear of the sinker bar 180, above the head rail 14 and in front of a jack spring bar 232 and the slur bar 234.

The jacks 204 and 212 can be retained in the jack bar assembly 202 in appropriate register with the sinkers 218 by a housing comprising a jack bar base 240 attached to the head rail 14, jack bar pillars (not shown) being provided at each end of the jack bar base 240. The jack pillars mount the ends of the pivot wires 206 and 214, alignment bars 241 and trick cut bars 250 which serve to locate one jack wall 248 between each pair of jacks 204 and 212. The jack walls 248 are held onto the base 240 by a clamping plate 252 and each have a recess 254 to enable the slurcock 210 to pass along the rear of the jacks 204.

The slurcock profile (adapted for a leverage of 3) is shown in FIG. 13. Using the high leverage, the slope $\alpha$ at the forward extremity of the slurcock 210, which is the steepest part of the profile, can be made small. The slurcock engages the jacks 204 about halfway between the pivot 214 and the nose 224.

FASHIONING HEAD

Figure 3:
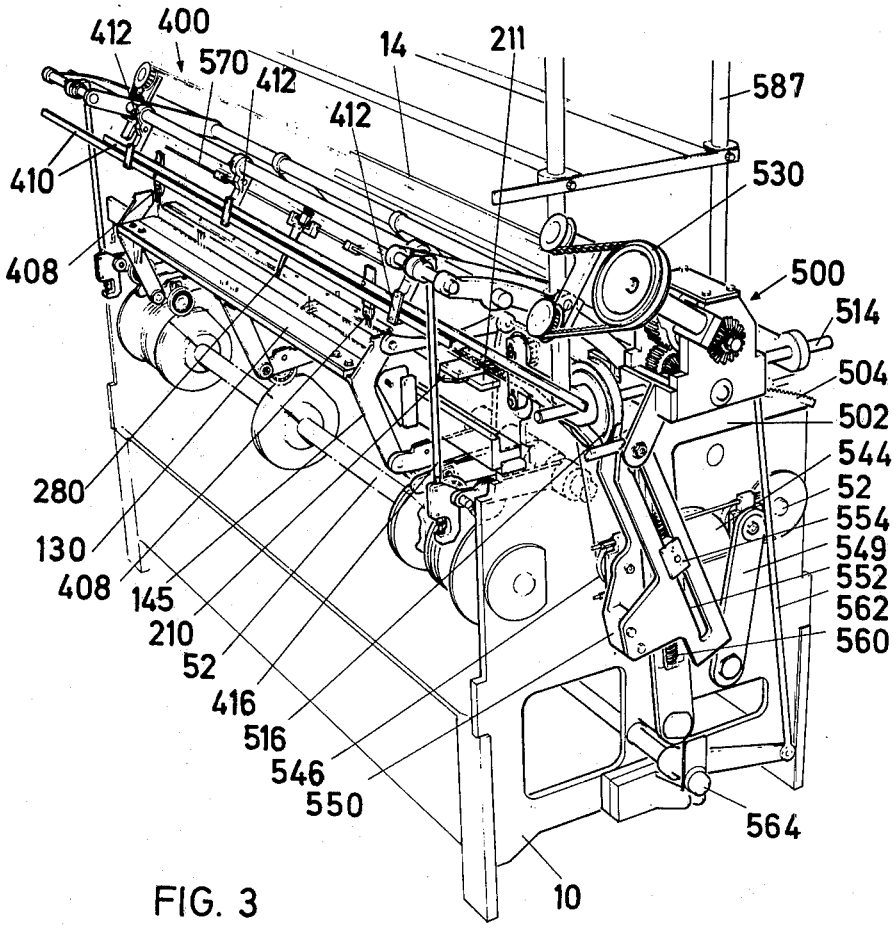
FIG. 3 is a perspective view of the knitting machine of FIG. 1.

With reference to FIGS. 2 and 3, each knitting head has associated therewith a fashioning head generally indicated at 400 (FIG. 3). Each head comprises (See FIG. 2) a fashioning frame 402 pivotably mounted for movement about an axis between the knitting heads on the sides using fashioning frame arms 404 and at intermediate positions through links 406. The fashioning frame 402 carries the usual fashioning points 408 (See FIG. 3) mounted on slide rods 410 in bearings 412. The points 408 can be shifted sideways by lead screws 409 (FIG. 1) operated by pawls (not shown) in the usual way in the course of a fashioning cycle. The parts associated with the lead screw for turning it are not shown for clarity and can be accommodated centrally between the knitting heads.

The fashioning frames are raised and lowered by cam packs 414 (FIG. 1) one at each end of the knitting machine through bell crank levers 415 and adjustable lifter rods 416 (shown in FIGS. 1 and 2).

DRAW MECHANISM

A draw mechanism is combined with the machine component previously described for laying in yarn during the draw cycle. The mechanism includes a differential 500 on the right hand side of FIG. 1. The differential 500 (See FIG. 6) receives an input from a quadrant gear 502 by means of teeth 504 thereon which meshes with an input pinion 506 in turn meshing with a differential pinion 508. The input pinion 506 also carries a first output bevel gear 510 meshing with a pair of bevel gears 512 (FIG. 5) to turn shafts 514 for rotating slurcock drive pulleys 516. The shafts 514 projecting in opposite directions turn in opposite senses. The differential input pinion 508 (FIG. 6) meshes with pinions 518 on a pinion cage 520 which is rotatably mounted around differential output pinion 522 fast to a second output bevel gear 524 meshing with a pair of bevels gears 526 to turn shafts 528 in opposite senses for rotating carrier drive pulleys 530. The pinion cage 520 is reciprocable to provide a subsidiary input which is superimposed on the input from the quadrant gear 502 to vary the rotation of the carrier drive pulleys 530 with respect to the slurcock drive pulleys 516.

The pulleys 516, 530 cooperate with freely rotatable pulleys 532, 534 on the left hand side of the machine as seen in FIG. 1 and guide flexible strongbelts 536, 538 to extend longitudinally along the knitting head. The belts are Uniroyal Internal tooth type belts known as HTD belts. The belts on the pulleys 530 may drive the carriers directly using a single carrier as in FIG. 1 and related Figures but the pulleys 530 preferably drive input shafts 540 (FIG. 2) for a plurality of alternatively operable carrier belts 541 mounted on pulleys 542. The belts can be selected for example by pneumatically operated clutches.

Figure 5:
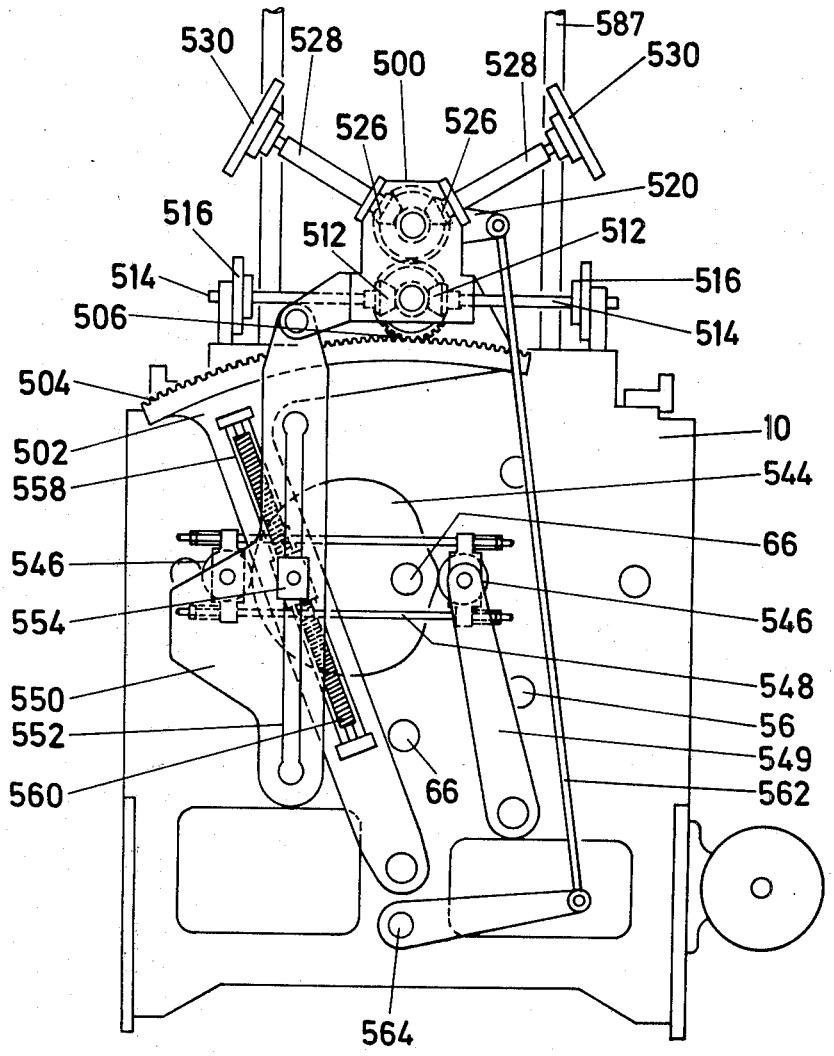
FIG. 5 is an end view from the right in FIG. 1 of the carcass and draw mechanism of the machine of FIG. 1 and FIG. 2.
Figure 6:
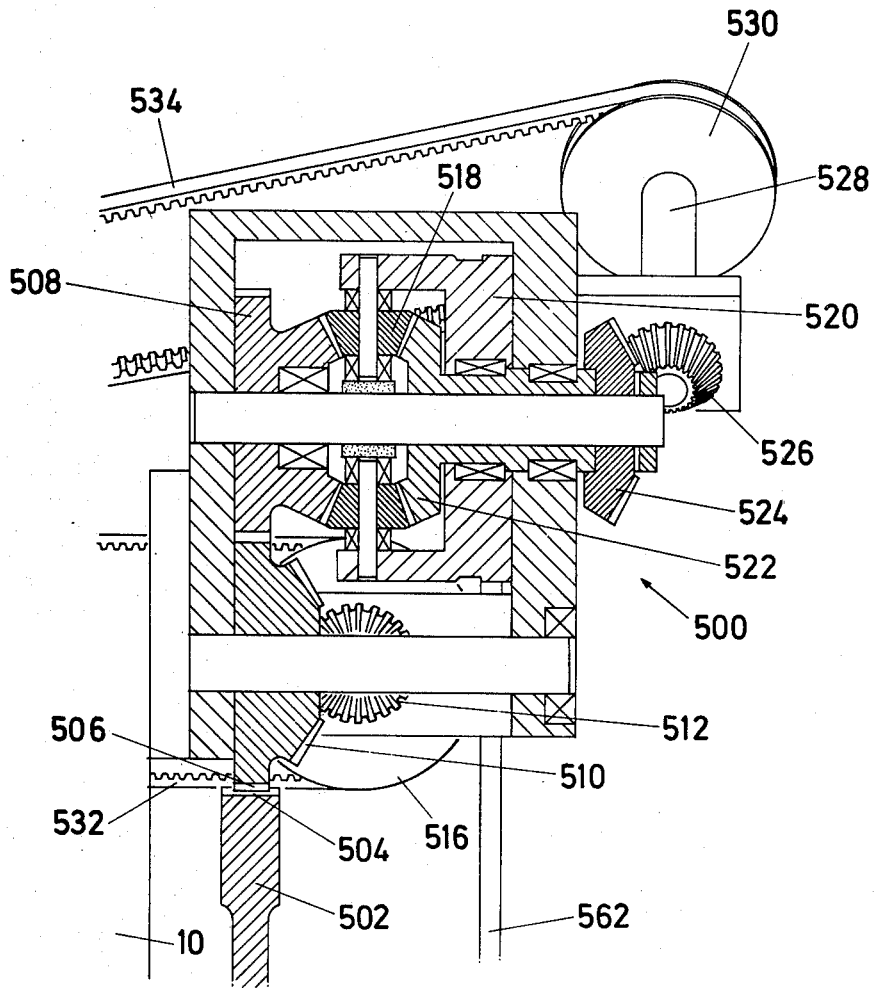
FIG. 6 is a section through a differential for the machine of FIGS. 1 and 2.

The quadrant gear 502 is arranged to provide a variable draw motion and input to the differential 500 (See FIGS. 3, 5 and 9). A draw cam 544 is mounted on the previously mentioned half-speed shaft 66 (FIG. 5) and engages cam follower rollers 546 mounted between tension rods 548 one on each side of the draw cam 544. One roller 546 is mounted on an upstanding primary lever 549 whilst the other roller 546 is mounted on a depending primary lever 550. As the cam 54 rotates the levers 549 and 550 are moved to and fro through a constant angle.

The lever 550 (FIGS. 3,5,9) comprises a pair of parallel arms which each have a slot 552 mounting a connecting block 554 slidable in the slots 552. The blocks 554 mount between them a pivotable block 556 received in a slot 558 in the quadrant gear 502. A screw 560 extends longitudinally in the slot 558 and engages the block 556. The screw 560 can be turned controllably by bevels (not shown) arranged concentrically with the centre of the quadrant 502 to raise or lower the block 556 in the slot 558 so as to vary the leverage with which the primary lever 550 acts on the quadrant 502 and the arc through which the quadrant 502 pivots.

The pinion cage 520 is reciprocable by a rod 562 mounted on a shaft 564 (See FIGS. 5 and 9). The shaft 564 is oscillated by a lever (not shown) operated by a pack of cams 563 (See FIG. 8) on the aforesaid half speed shaft 66. By sliding the pack 563 axially, the timing of the oscillation of the shaft 564 is varied at the same time as the extent of the quadrant lever reciprocation is varied to ensure optimal slurcock/carrier operation at different draw widths as will be explained.

Figure 14:
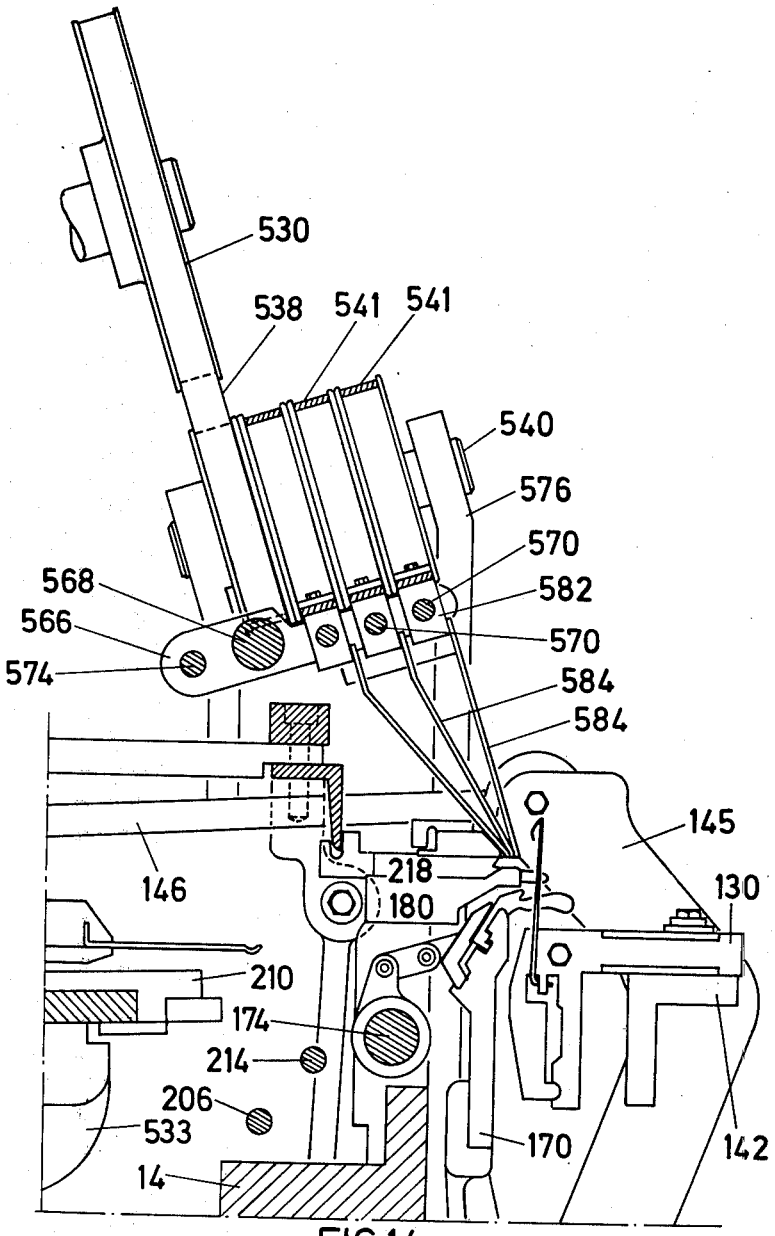
FIG. 14 shows a schematic transverse section through the top of themachine of FIG. 2.

The slurcock 210 is connected to the belt 536 (See FIGS. 2 and 3). The belt 536 passes over the end standards 10 but below the fashioning frame 402. The belt 538 or 541 for the carriers pass at least partly under the frame 402 and extend over a carrier guide rod assembly (See FIGS. 2, 8 and 14).

Figure 20:
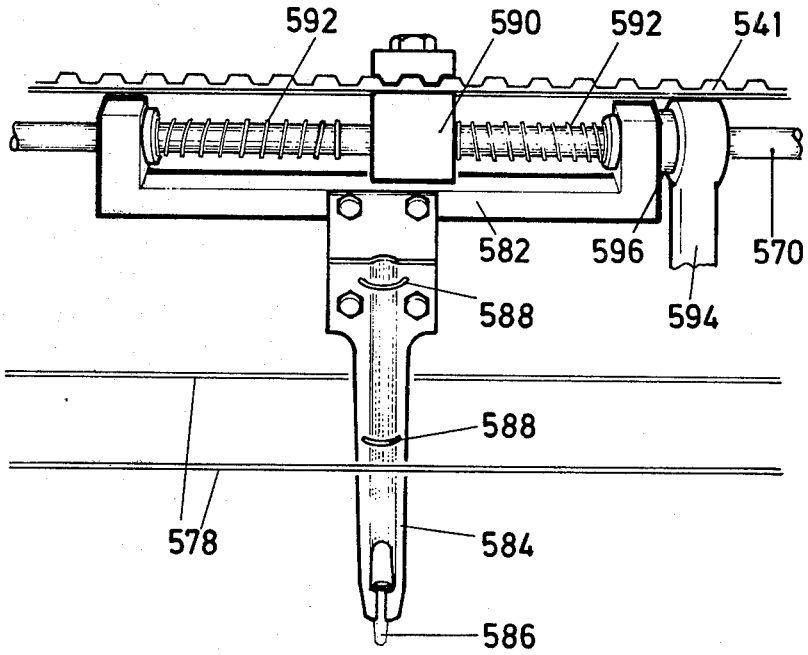
FIG. 20 is a perspective view of a yarn carrier of the knitting machine of FIG. 1 and FIG. 2.

The carrier guide rod assembly comprises a pair of end brackets 566 spaced apart by a thick spacer rod 568. Between the end brackets 566 extend carrier guide rods 570 tensioned by nuts 572. The tension on the rods 570 is counterbalanced by countervailing tension applied to a rod 574. The assembly is bolted by arms 576 to the head rail 14 of the knitting machine. The arms 576 at the respective ends of the knitting head mount between them a set of guide wires 578 (FIGS. 8,20) to confine the respective carriers 580 and avoid collisions between them.

The carriers 580 (See FIG. 20) each comprise a body 582 sliding on the rail 570 at two spaced positions and having a depending carrier back 584 projecting between the wires 578. The carrier back 584 has a tube 586 and guide eyes 588 for yarn. The body 582 is connected to the respective belt 541 by a drive block 590 on the rod 570. The block 590 is spaced from the body 582 in the longitudinal direction of the rails 570 by compression springs 592.

The carrier guide rail assembly also mounts adjustable stops 594 for the carriers having associated therewith rubber bushes 596. The stops 594 are movable sideways by the aforementioned lead screws 409 in conjunction with the fashioning operation.

OVERALL CONFIGURATION

Figure 10:
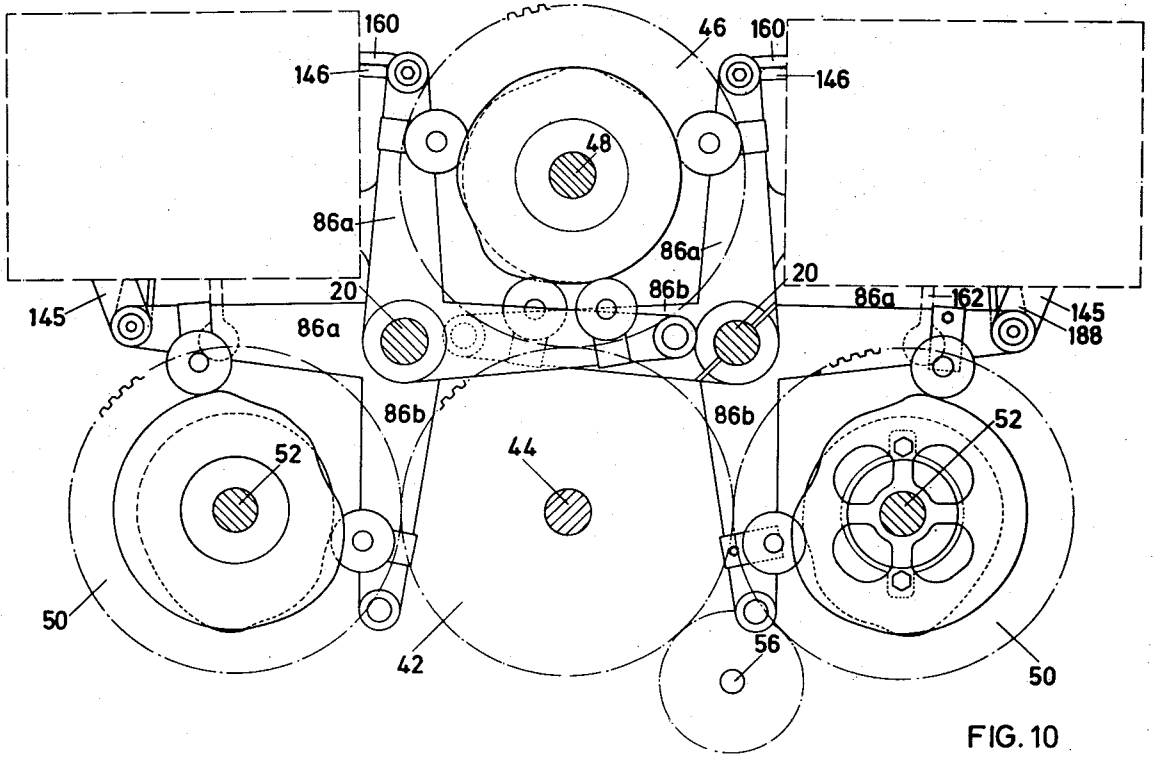
FIG. 10 is a schematic transverse section through the top of the machine of FIG. 1 and FIG. 2 whilst
Figure 19:
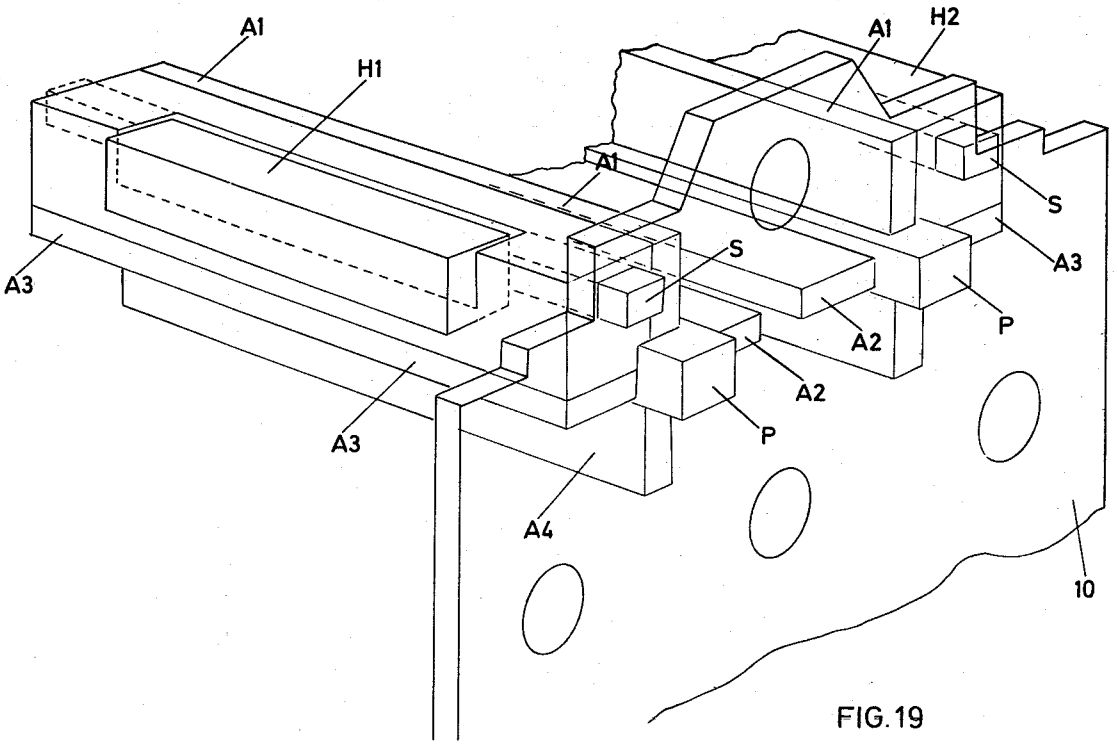
FIG. 19 is a perspective view in diagrammatic form of part of a knitting machine of the invention.

With reference now particularly to FIG. 10 and FIG. 19, it can be seen how the various levers have been arranged in an orderly and compact manner. The upright lever arms 86*a* to which various links or connecting arms 146 are connected from arrays A1 at each end behind the two knitting heads. The other lever arms 86*b* associated with the lever arms 86*a* form arrays A2 under the cam packs on the top cam shaft 48, the arrays A2 of the respective knitting heads overlapping. The sideways extending lever arms 86*a* to which various updown links 118,162 are connected to form arrays $A_3$ at each end under the knitting heads. The other lever arms 86*b* associated therewith form arrays $A_4$ behind the bottom cam shaft 52 under the top cam shaft 48.

The lever arms in the arrays operate in a narrow longitudinally extending space between the end standards 10 and the various components of the knitting heads fit in front of and above the arrays lever arms.

The transmission of movement from the cam packs to the links e.g. 146,160 is generally direct and the reciprocating masses are small. The knitting heads are at the front and rear of the machine.

With reference to FIG. 19, the area occupied by the knitting head is shown as $H_1$ on one side and $H_2$ on the other side. It can be seen how $H_1$ fits partly into the L-shaped space occupied by the various levers. The knitting heads can be reached by links at intermediate positions but only to the rear and bottom parts of the knitting head so as to leave an unobstructed area for receiving yarn from the traversing carriers for forming into fabric. The area occupied by the slurbar S extends through the rectangular apertures formed by the links and levers at the ends of the knitting head. The levers are pivoted in areas P arranged virtually diagonally opposite the fabric formation zone in the knitting heads $H_1$ and $H_2$. The fabric formation zone is above the knockover bits and between the needles and sinker bar.

FIG. 3 shows that the draw mechanism can be combined with the configuration described without appreciably increasing its size or interfering with different knitting or fashioning motions.

The knitting machine further contains a fabric take down mechanism which may be of conventional design and the cam shaft shogging mechanism described previously on the left hand side as seen in FIG. 1. Yarn is supplied preferably by a feed device adapted to provide yarn at low tension but capable of taking up slack at the end of a draw motion. A suitable device called "Air tensioner and take-up facility" is made and sold by Hosiery Equipment Ltd., of Leicester following a HATRA development. The yarn passes through the fashioning frame 402 and carrier guide rail assembly to the tubes 586 from bobbins (not shown) supported on rods 587 (See FIG. 3).

OPERATION OF KNITTING MACHINE

Many of the operations on the knitting machine follow the same lines as in conventional multi-section straight bar machines. The following description emphasizes mainly the details of operation which are a consequence of the invention.

In operation knit cycles will alternate with draw cycles and from time to time a fashioning cycle will take place.

Starting with the draw cycle (See FIG. 21), the yarn carrier 580 which is operative (the others are parked inactive with their belts 541 uncoupled from the shaft 540) is moving from right to left at say a "front" knitting head, whilst simultaneously another carrier is moving from left to right at a "rear" knitting head when seen from the front. The carrier 580 leads the slurcock 210 so that the yarn trailing from the carrier (shown in chain dotted line) firstly passes over the sinker noses (the extreme forward ends of which are shown in solid lines) in front of the sinker nibs shown in dotted lines and secondly is kinked between the needles (not shown) whose stems are slightly in front of the nibs (Stage a). At the end of the traverse, whilst the slurcock 210 is still moving, the body 582 of the carrier 580 impacts with the bush 596 of the stops 594 whilst the block 590 compresses the spring 592 on the leading side (Stage b). The part 584 of the carrier 580 is thus stopped instantly, even though the belt 541 continues its travel. The pinion cage 520 is now moved by the rod 562 in such a way that whilst the slurcock 210 continues its traverse, the carrier 580 is held still (Stage c).

The slurcock 210 and carrier 580 will both come to rest in the middle of sinkers 218 as the draw mechanism is of the variable draw type and the description so far relates to a traverse at less than full width.

The draw cam 544 now comes to a sector in which the draw quadrant 502 is held stationary, and a knitting cycle can now take place. First the slurbar 234 is moved back by operating the lever carrying the slurbar mountings 233 and the catch bar 154 moves all remaining sinkers 218 on the side of those advanced by the slurcock outward from the sinker bar 180 between the needles with the catch bar 154 at an intermediate height. The catch bar 154 is lowered into the recess formed by the sinker butts so as to positively hold against the sinkers 218 for movement in either direction. The cams on the shafts 52 and 48 now cause the different lever arms 86*a* and 86*b* to move in proper synchronisation to give the chain dotted track in case of the needles and the dotted track (See FIG. 11) in case of the knockover bar 170 whilst the sinkers 218 move to and fro to provide the usual knitting cycle. The kinked loops of yarn are taken into the hooks of the needles, the needle bar 130 moves to press the beards against the sinker bar 180 and thereby against the needle stems, the old loop is knocked over the top of the needles aided by the motion of the knockover bar 170 and withdrawal of the sinkers 218. The needles then rise and are once again located in the draw position. The catch bar 154 is raised to the intermediate height to free the sinkers 218 for forward movement. During the knitting cycle, the various bars are positively controlled during their complex movement and vibration can be reduced even at high knitting speeds to acceptable levels.

Figure 21:
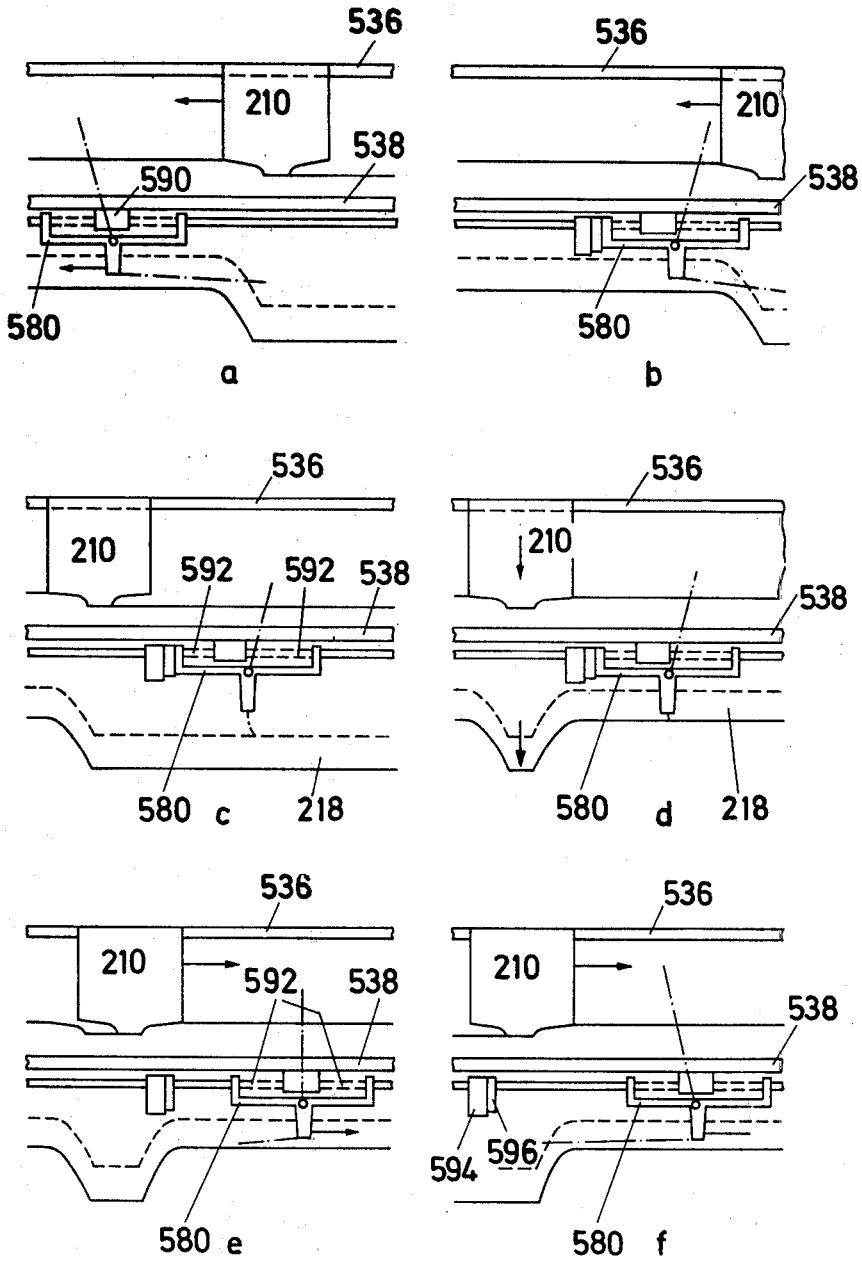
FIGS. 21(*a*) to (*f*) are plan views of the successive stages at the end and start of a slurcock/carrier traverse.

The next draw cycle from left to right in FIG. 21 can now commence. The slurbar 234 is moved forward projecting some sinkers 218 which are however devoid of yarn (Stage d). The draw lever 502 then commences to move whilst the carrier 580 remains in the same position.

As a result the slurcock 210 and the carrier 580 accelerate. The spring 592 relaxes (Stage E) and the slurcock and carrier traverse back with the carrier leading the slurcock as required (Stage f). The operation previously described is then repeated.

Figure 22:
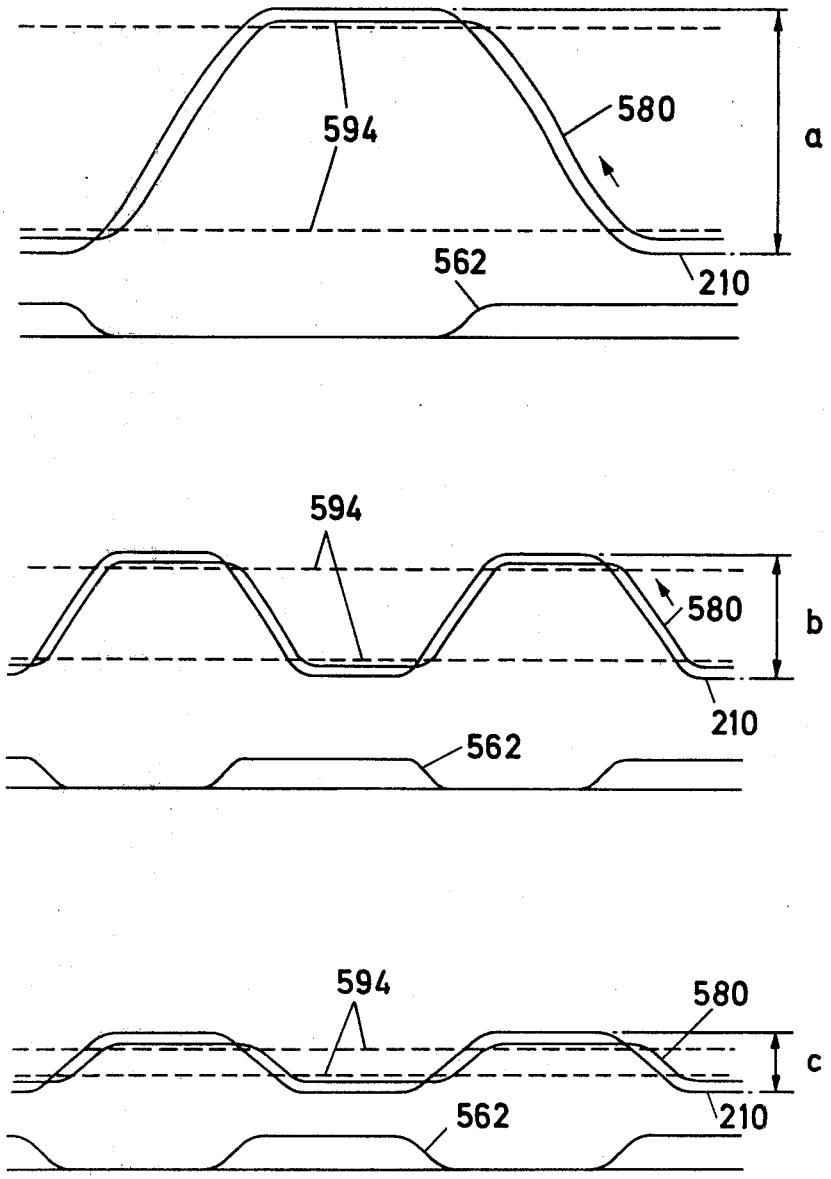
FIGS. 22(*a*) to (*c*) are timing diagrams of the slurcock/carrier traverse at different knitting widths.

FIG. 22 shows schematically the timing of the drawn motion. The vertical axis represents the draw width (shown in dotted lines). The horizontal axis represents time which moves from right to left. The arrow represents the direction of movement of the slurcock and yarn carrier. At a full draw width (FIG. 22*a*), the carrier 580 always travels in front of the slurcock 210 even though the extent of the slurcock traverse is greater. The motion of the pinion cage 520 is used to reverse the slurcock yarn carrier position at the end of each traverse. Whilst the drawing shows the actual slurcock movement, that of the yarn carrier is stopped by the stop 594 at the level of the dotted lines with the spring 592 compressed as described. FIG. 22*b* shows the arrangement at half draw width. The speed of the cam shaft rotations has been doubled so that there are twice as many draw motions for a given period. The slurcock-carrier speed is thus effectively unaltered but the knit cycle is performed near to its maximum speed. FIG. 22*c* shows the situation at "zero" draw width. The draw speed is reduced because the knit cycle has to be executed at a similar speed as previously.

The machine of the invention can thus be utilised to work: 1 near the maximum draw speed initially largely limited by the slurcock/jack impact whilst working below the maximum knit cycle speed when operating at full width and to work 2 near the maximum knit cycle speed at small draw width whilst working below the maximum draw speed.

Figure 23:
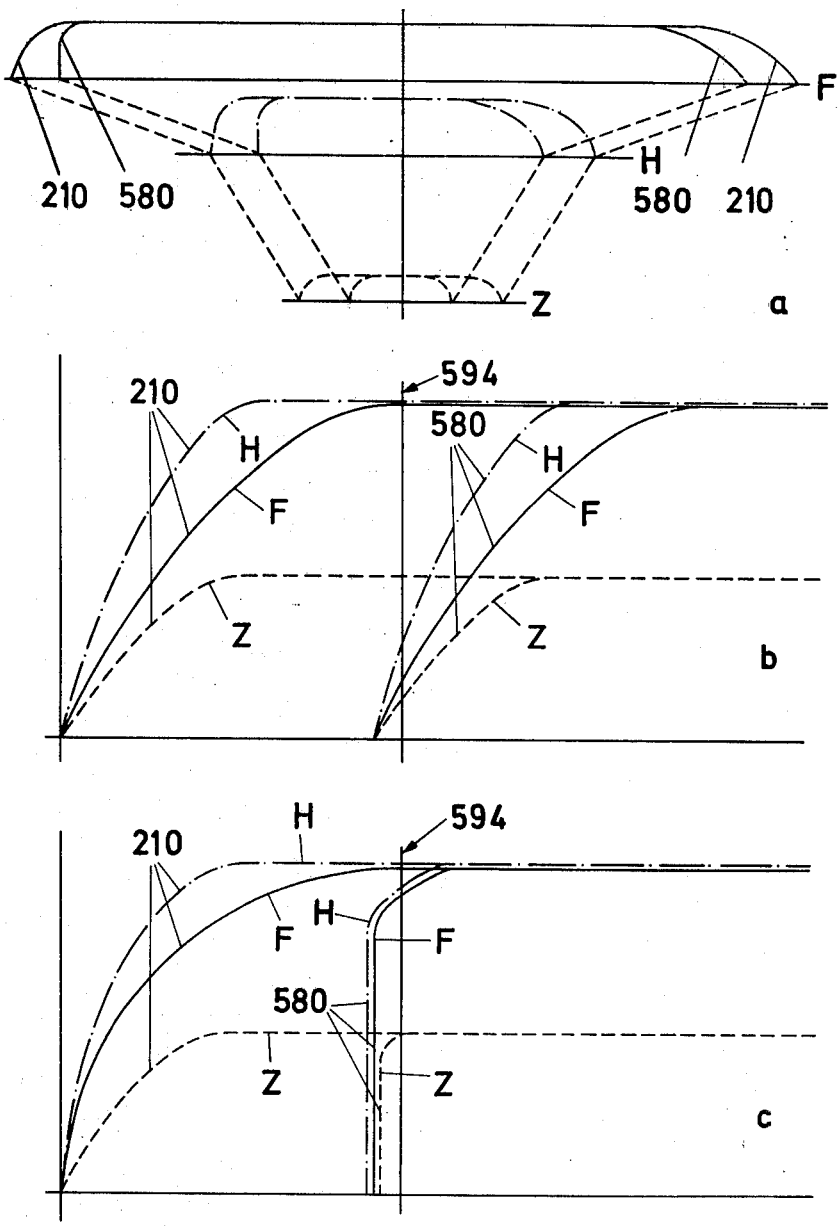
FIGS. 23(*a*) to (*c*) are velocity diagrams of the slurcock/carrier at different knitting widths.

The details of the velocity variations are illustrated in FIGS. 23*a* to *c*. FIG. 23*a* shows full draw width at F, half draw width at H and zero draw width at Z. The vertical axis represents speed. Moving from right to left it can be seen how the carrier 580 and its belt 541 decelerate suddenly as the carrier 180 meets the stop 594. The draw speed is unaltered at half draw width but reduced considerably at zero width. With reference to FIG. 22*b*, this illustrates accelerations of the slurcock and yarn carrier drive belts at different draw widths. It can be seen that the yarn carrier only reaches full speed when well away from the stop 594 but this does not matter as knitting of yarn only starts when the slurcock moves past the stop by which time full speed has been reached. FIG. 22*c*, shows deceleration of the slurcock and yarn carrier belts at the end of the draw. The carrier 580 is slowed down marginally by the differential prior to meeting the stop and is then held against the stop as the belt travels on to a small extent. FIG. 22*b* and 22*c* shows the velocity of the slurcock 210 and its drive belt (which are the same). The carrier 580 stops at the solid vertical line representing the position of the stop 594. The cam controlling the pinion cage 520 is axially movable to vary the duration of the yarn carrier deceleration period relative to the overall draw motion. Without such axial shifting to bring up a different cam profile, the proportion of the draw lever motion during which the yarn carrier decelerates, would increase as the draw width reduces so interfering with proper yarn carrier movement.

Whilst knitting is in progress the fabric is taken down by a hook-up bar (not shown) biased to withdraw fabrics from the needles in the usual way.

To initiate fashioning, the clutch 62 (see FIG. 9) is shifted to prevent further rotation of the draw cam 544 and the cam shafts for the up-down and in-out motions are shogged to bring cam profiles appropriate to fashioning under the cam followers 114. Fashioning then takes place in the usual way. During carrier widening the pressure of the spring 592 which is compressed causes the yarn carrier 580 to follow the motion of the stop 594 controlled by a lead screw (not shown).

I claim:

1. A draw mechanism for a straight bar knitting machine having a positively driven slurcock and yarn carrier, comprising a fixed guide rod for the yarn carrier, a belt for pulling the yarn carrier in each direction of traverse, a drive member secured to said belt and slidable on the guide rod for reciprocating the yarn carrier with respect to the guide rod, and resilient means interposed between the drive member and the yarn carrier to resiliently urge the carrier to a normal position with respect to the drive member.

2. A draw mechanism as claimed in claim 1, wherein the drive member is a drive block slidable on the guide rod located between spaced bearing portions of the yarn carrier and wherein said resilient means comprises compression springs mounted between the bearing portions and the drive block.

3. A draw mechanism as claimed in claim 2, in which the compression springs envelop the guide rod.

4. A draw mechanism as claimed in claim 1, in which a plurality of yarn carriers are mounted on a plurality of guide rods tensioned between a pair of mountings.

5. A draw mechanism as claimed in claim 4, wherein the drive means comprise a plurality of belts for pulling a plurality of yarn carriers in each direction of traverse, the guide means comprise a plurality of fixed guide rods, each of the belts carry a drive block slidably mounted on the respective guide rods, each of the carriers have a pair of bearing portions connecting the carrier slidably to the respective guide rod to either side of the drive block and compression springs are mounted around the guide rods interposed between the drive blocks and the bearing portions.

6. A draw mechanism as claimed in claim 4, in which mountings secure the ends of the guide rods, a spacer member holds the mountings apart and a tensioning rod is mounted under tension between the mountings on the opposite side of the spacer member from the guide rods to thereby stiffen the guide rods by applying tension thereto.

7. A draw mechanism as claimed in claim 1, in which a wire is provided for guiding a yarn laying projection of the carrier.

8. A draw mechanism as claimed in claim 1, in which a differential drive mechanism is provided having first and second outputs for driving the slurcock and the yarn carrier positively such that the carrier leads the slurcock in both directions of traverse.

* * * * *